US005711499A

United States Patent [19]

Sectish

[11] Patent Number: 5,711,499

[45] Date of Patent: Jan. 27, 1998

[54] PLASTIC SHOPPING BAG RECYCLING WASTEBASKET

[76] Inventor: Michael G. Sectish, 769 11th Ave., Paterson, N.J. 07514

[21] Appl. No.: 566,695

[22] Filed: Dec. 4, 1995

[51] Int. Cl.[6] ..... B65D 90/04

[52] U.S. Cl. ..... 248/97; 220/404

[58] Field of Search ..... 220/404; 211/12; 248/95, 97, 99, 101, 907

[56] References Cited

U.S. PATENT DOCUMENTS

| | | | |
|---|---|---|---|
| 2,308,398 | 1/1943 | Stevens | 220/404 X |
| 3,757,990 | 9/1973 | Buth | 220/404 |
| 4,086,475 | 4/1978 | Churchill | 235/419 |
| 4,267,928 | 5/1981 | Curry, Jr. | 220/404 X |
| 4,576,310 | 3/1986 | Isgar et al. | 220/404 |
| 4,664,347 | 5/1987 | Brown et al. | 220/404 X |
| 4,974,746 | 12/1990 | Dickinson | 220/404 |
| 5,054,724 | 10/1991 | Hutcheson | 220/404 X |

FOREIGN PATENT DOCUMENTS

| | | | |
|---|---|---|---|
| 1114832 | 4/1956 | France | 211/89 |
| 463303 | 4/1951 | Italy | 211/89 |
| 290099 | 5/1928 | United Kingdom | 211/89 |

*Primary Examiner*—Ramon O. Ramirez
*Assistant Examiner*—Stephen S. Wentsler
*Attorney, Agent, or Firm*—Alfred C. Hill

[57] ABSTRACT

A plastic shopping bag recycling wastebasket, comprising a shopping bag having a pair of plastic handles, a rectangular wastebasket having a predetermined rectangular dimension, a predetermined height dimension and an open top having a bulb-type rim therearound; and four longitudinal slots, each of the four slots being disposed in a different corner of the basket. The slots receive and retain in place the pair of handles after the shopping bag is inserted in the basket. The handles are disposed externally of the basket when received and retained in the four slots. Four concave cavities extend downward from the rim with each of the four cavities disposed in a different corner of the basket. The associated one of the four slots are disposed at the bottom of an associated one of the four cavities. The four cavities assist in the pair of handles engaging the four slots.

4 Claims, 3 Drawing Sheets

PLASTIC SHOPPING BAG RECYCLING WASTEBASKET

BACKGROUND OF THE INVENTION

The present invention relates to an article for holding flexible sacks and more particularly to a wastebasket for holding in an upright, open position, a standard grocery or department store bag of the type made from a flexible plastic film.

For many years, grocery stores, as well as other retail stores, pack goods purchased by the shopper in paper bags. The paper bags provided a convenient means for carrying groceries directly to the shoppers' residence, or to his or her vehicle for the trip home.

Once the groceries were unloaded from the paper bags, the bags were at times used as receptacles for accumulating garbage and other refuge prior to disposal of their refuge. For this purpose, the bags were used either standing alone, or inserted as liners into waste containers, such as regular or standard wastebaskets. It now appears that the brown paper bag is definitely doomed to extinction because it is subject to easy rupture, tearing and unable to withstand the weathering of rain and snow, and too often the bag will burst on the way home from the market by being pierced or punctured by the sharp corners of the contents. Also, it is very cumbersome to carry more than one bag at the same time.

In relatively recent times, the paper grocery bag has begun to be replaced by bags made from a flexible plastic film. The plastic bags have been tauted by large supermarkets and similar retail stores as being the wave of the future, and a great convenience to shoppers.

However, when the relative merits of paper bags versus plastic bags are weighted, it seems clear that economic considerations and the fact that plastic bags have been dispensed with increasing frequency by stores, that the use of paper bags will become more scarce. It is equally clear that plastic grocery bags by themselves are not generally used as trash receptacles, since they collapse into a limp lump or pile when placed unsupported on the floor.

Nationally, all of the supermarkets and department stores and other merchants use the plastic shopping bag because it is durable, waterproof and easy to pack. Also the plastic shopping bags are easier for the customer to carry due to the ability to carry more than two bags at once using the handles of the plastic shopping bag.

Production of the plastic shopping bag is now over one billion annually and cost the store owners less than 3 cents each.

In todays' world every effort is being made to conserve our natural resources by recycling.

There are a number of U.S. patents that have proposed various arrangements to support the limp plastic shopping bag in a manner to maintain the shopping bag in an upright and open condition so that the plastic shopping bag can be used as a liner for a wastebasket.

The following U.S. Pat. Nos 4,805,857; 4,890,652; 4,907,710; 4,921,193; 4,930,734; 5,054,724 and 5,100,087 are representative prior art patents that are concerned with devices that hold the limp plastic shopping bag to stand upright, erect and open for re-use at home using all types of apparatus, hooks, rods, wire racks and many other devices, none of which have been successful, or have even been placed on the market. The prior art in the above cited patents, also represent other devices attempting to hold the limp plastic shopping bag in an upright, erect and open condition for re-use at home.

SUMMARY OF THE INVENTION

An object of the present invention is to provide a plastic shopping bag recycling wastebasket that is an improvement over the known prior art.

Another object of the present invention is to provide a plastic shopping bag recycling wastebasket which is simple in design and a real practical solution to the problem of holding the limp plastic shopping bag in an upright, erect and open condition for re-use at home.

Still a further object of the present invention is to provide a plastic shopping bag recycling wastebasket to utilize and recycle the standard plastic shopping bag as a container for waste that is easy to insert, easy to remove, low in cost and economical to manufacture so that it would become a part of every household need, janitorial need in offices of every type of business, the guest rooms of hotels and motels and many public restrooms.

Another object of the present invention is to provide a plastic shopping bag recycling wastebasket design that will make it possible to use the handles of the standard plastic shopping bag to hold the shopping bag upright and rigid within the wastebasket, that does not require the usual unsightly draping the plastic bag over the rim of the wastebasket and finally using the handles to securely tie the bag closed when filled and ready for disposal.

A feature of the present invention is the provision of a plastic shopping bag recycling wastebasket shopping bag having a pair of handles, a rectangular wastebasket having predetermined rectangular dimensions, a predetermined height dimension and an open top having a rim therearound; and four longitudinal slots, each of the four slots being disposed in a different corner of the wastebasket to receive and retain the pair of handles after the shopping bag is inserted in the wastebasket, the handles being disposed externally of the basket when received and retained in the four slots.

Another feature of the present invention is the provision of the above-mentioned wastebasket having four concave cavities extending downward from the rim, each of the four cavities being disposed in a different corner of the wastebasket, the associated one of the four slots being disposed at the bottom of an associated one of the four cavities, the four cavities assisting in the pair of handles engaging the four slots.

BRIEF DESCRIPTION OF THE DRAWING

Above-mentioned and other features and objects of the present invention will become more apparent by reference to the following description taken in conjunction with the accompanying drawing, in which:

FIG. 6 is a side elevational view of the recycling wastebasket in accordance with the principles of the present invention illustrating the tying of the plastic bag upon being partially removed from the interior of the recycling wastebasket to enable disposal of the waste in the plastic bag.

DESCRIPTION OF THE PREFERRED EMBODIMENT

Figure 1:
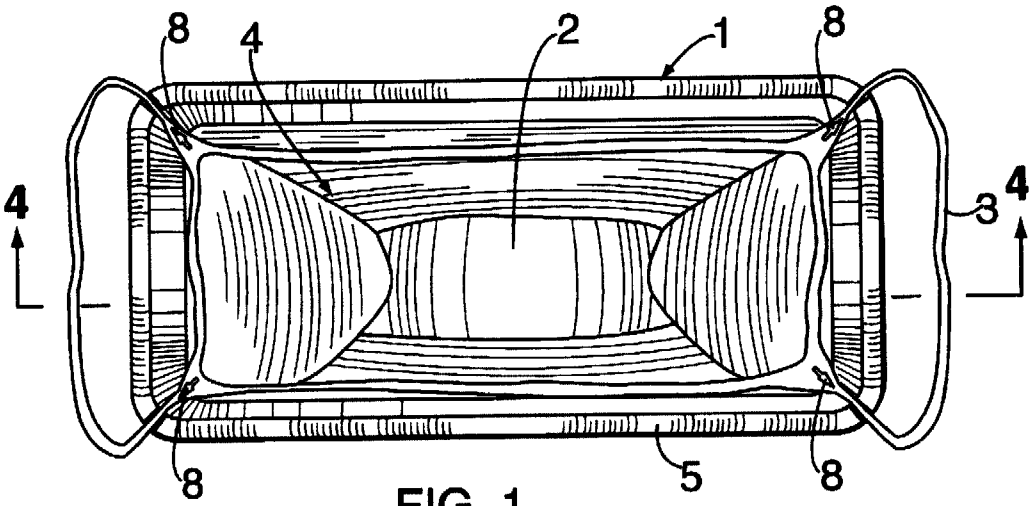
FIG. 1 is a top view of the recycling wastebasket in accordance with the principles of the present invention.
Figure 2:
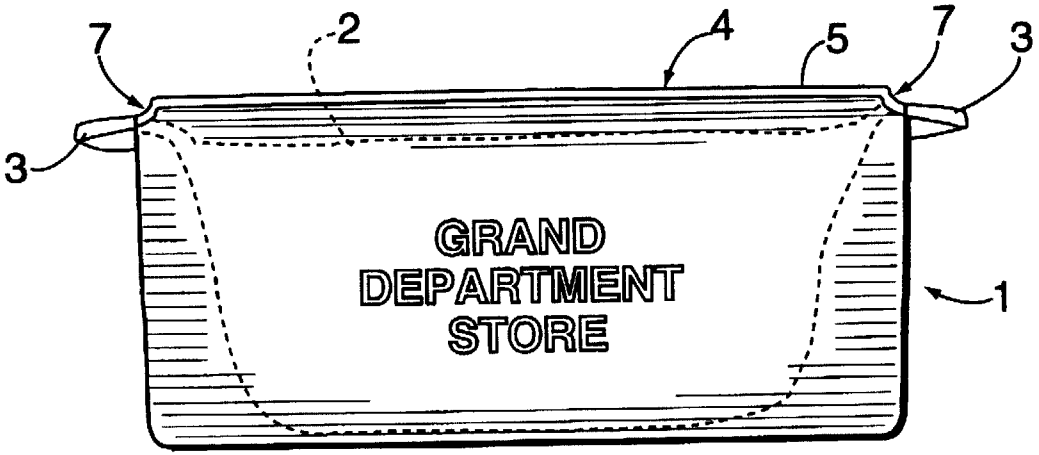
FIG. 2 is side elevational view a of the recycling wastebasket in accordance with the principles of the present invention.

FIGS. 1-4 illustrate the plastic shopping bag recycling wastebasket 1 with the shopping bag 2 having a pair of handles 3. The wastebasket 1 is a rectangular wastebasket having predetermined rectangular dimensions, a predetermined height dimension and an open top 4 having a bulb-type rim 5 therearound.

Figure 5:
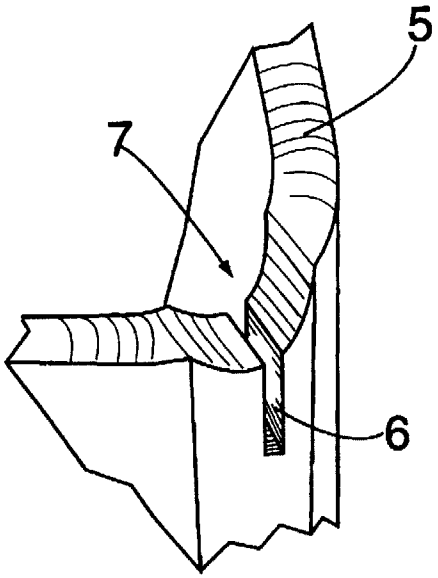
FIG. 5 is an enlarged detail of each corner of the recycling wastebasket in accordance with the principles of the present invention.

The recycling wastebasket 1, in addition, includes in each corner thereof a longitudinal slot 6 shown in greater detail in FIG. 5 to receive and retain the pair of handles 3 after the shopping bag 2 has been inserted in wastebasket 1. The handles 3 are disposed externally of the wastebasket 1 when received and retained in the four slots 6.

Figure 3C:
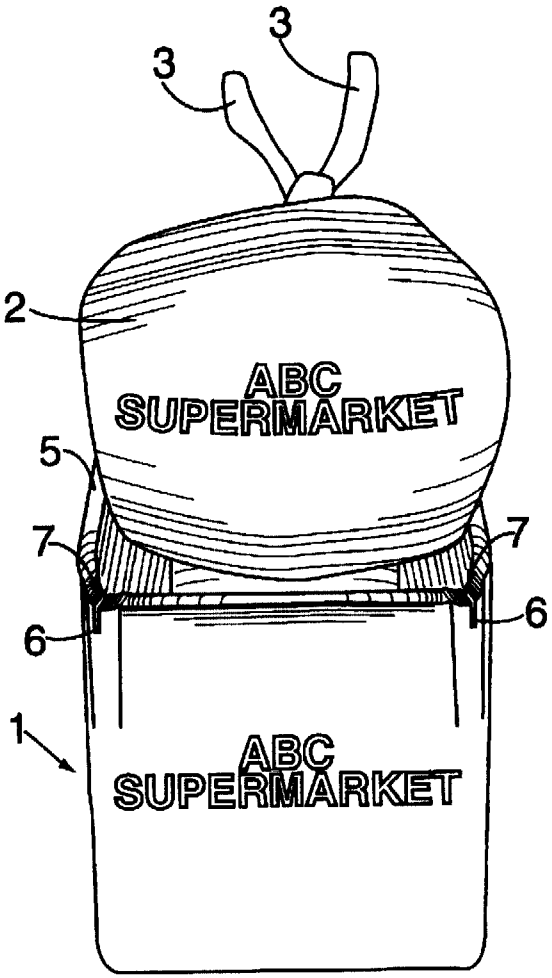
FIG. 3 is an elevational view of the narrow dimension of the recycling wastebasket in accordance with the principles of the present invention.
Figure 3B:
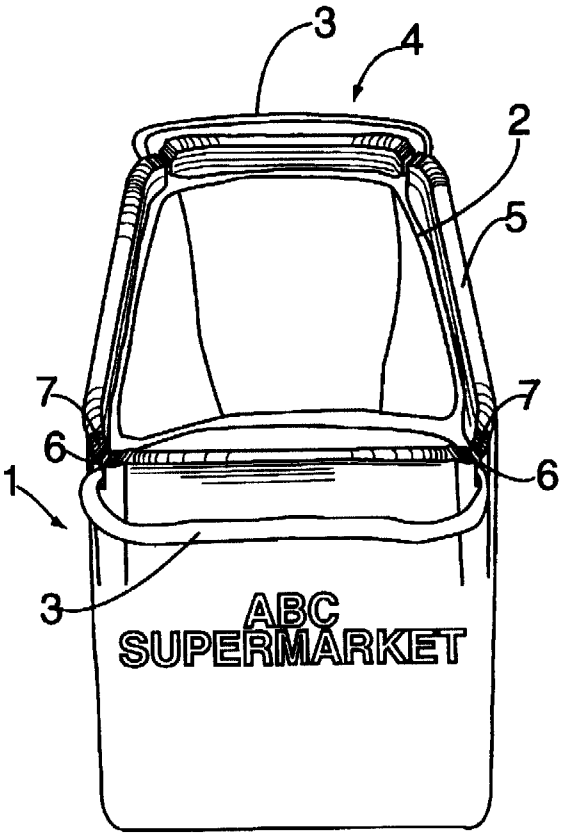
Figure 3A:
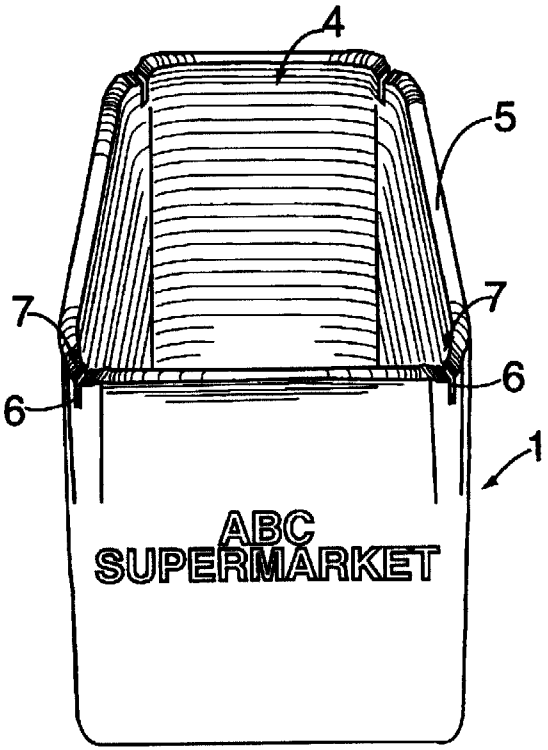

The handles 3 are pulled downward into and engage the slots 6 with an outward tension applied to the bag 2 by the handles 3 causing the shopping bag 2 to be pulled taut so that the wall of the shopping bag 2 will bear against the inner wall of the basket with the handles 3 remaining outside the wastebasket 1. When the shopping bag 2 is full of waste, a pull upward on handles 3 will enable easy removal of the shopping bag 2. When the shopping bag 2 is partially extracted from the wastebasket 1 the handles 3 are tied as shown in FIG. 3c to seal the waste in the shopping bag 2 for easy disposal thereof.

As shown in greater detail in FIG. 5, there is also provided in each corner of the rectangular wastebasket a concave cavity 7 disposed in the rim of the top of the wastebasket 1 to enable the plastic handles 3, which have two imprinted arrows 8 (Note FIG. 1), or registration marks, thereon to be more easily guided to engage longitudinal slot 6.

The rim 5 of the recycling wastebasket 1 is a bulb-type rim to render the wastebasket 1 more aesthetic and to also strengthen the recycling wastebasket 1.

The recycling wastebasket 1, in accordance with the principles of the present invention, makes it possible for the plastic shopping bag to have a double-duty use. Firstly, the original use of bringing home from the store the products purchased and, secondly, recycled for use as a wastebasket liner.

Figure 4:
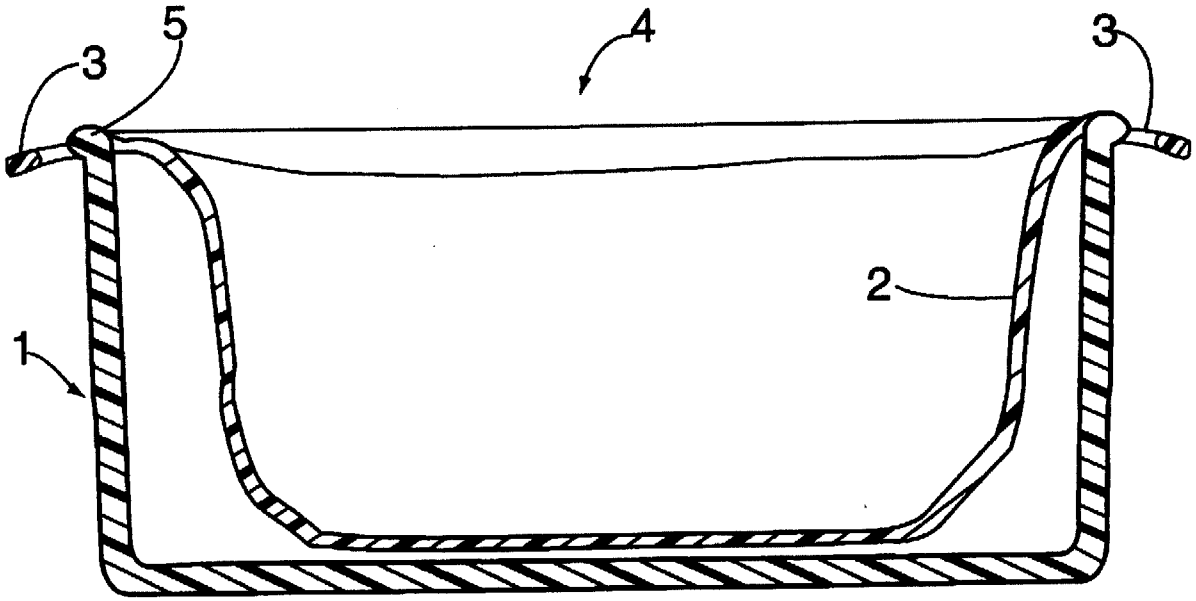
FIG. 4 is cross-sectional view taken along line 4—4 of FIG. 1.

The various dimensions of the recycling wastebasket 1 are appropriately selected to enable the plastic shopping bag 2 to completely fill the wastebasket 1 and assuring that the bottom of the shopping bag 2 is on the bottom of the recycling wastebasket 1 as shown in FIG. 4. The dimensions of the slot 6 and the bulb-type rim 5 may have the following dimensions as an example, the slot 6 can be ¾" long and 1/16" wide with the bulb-type rim 5 having a dimension of ¼".

It is granted that no family can shop often enough to accumulate a shopping bag for their daily need thereby contributing substantially to the recycling program. However, it will now be possible for the supermarkets and departments stores to package the very same bag they use, in units of 50, to retail for less than $2.25 and still give them a fair profit. This will greatly benefit the shopper because the average cost of a 20 quart, 13"×9"×15" plastic trashliner manufactured by the leading producers and sold in retail stores is 10 to 11½ cents per bag.

Another benefit to the shopper and an objective of the invention is that it would provide the opportunity for the stores to have its'logo and advertising message imprinted on the recycling wastebasket as shown in FIGS. 2, 3A, 3B and 3C and 6 and use it as a marketing promotion incentive by offering it free with a purchase of 200 plastic bags. It would appear that this would find enthusiastic response and acceptance by the shopper.

While I have described above the principles of my invention in connection with specific apparatus, it is to be clearly understood that this description is made only by way of example and not as a limitation to the scope of my invention as set forth in the objects thereof and in the accompanying claims.

I claim:

1. A plastic shopping bag recycling wastebasket comprising:

a plastic shopping bag having a pair of plastic handles;

a rectangular wastebasket having predetermined rectangular dimensions, a predetermined height dimension and an open top having a rim therearound, said rim having a bulb-like configuration;

four longitudinal, rectangular slots, each of said four longitudinal, rectangular slots being disposed centrally in a different corner of said rectangular wastebasket to receive said pair of plastic handles after said plastic shopping bag is inserted into said rectangular wastebasket with said pair of plastic handles being loosely disposed externally of said rectangular wastebasket when received in said four longitudinal, rectangular slots, said four longitudinal, rectangular slots and said pair of plastic handles cooperating to enable pulling on said pair of plastic handles outwardly to draw taut walls of said plastic shopping bag to provide a given orientation for said plastic shopping bag within said rectangular wastebasket to properly receive waste, said plastic shopping bag being maintained in said given orientation by only said four longitudinal, rectangular slots each having a predetermined width to enable gripping said pair of plastic handles when said given orientation is achieved, said given orientation including an open, rigid, upright condition with said walls of said plastic shopping bag being closely adjacent inner walls of said rectangular wastebasket and abutting a bottom of said rectangular wastebasket; and four concave cavities extending downward from said rim, at least each of said four concave cavities having an extension of said rim thereon, each of said four concave cavities being disposed symmetrically in a different corner of said rectangular wastebasket, the associated one of said four longitudinal, rectangular slots being disposed centrally of and at a bottom of an associated one of said four concave cavities, said four concave cavities assisting in said pair of plastic handles engaging said four longitudinal, rectangular slots.

2. A wastebasket according to claim 1, wherein said predetermined width of each of said four longitudnal, rectangular slots is selected to enable easy removal of said pair of plastic handles therefrom, as well as gripping said pair of plastic handles to maintain said given orientation, to assist in removing said plastic shopping bag from said rectangular wastebasket when full of said waste, said pair of plastic handles being tied together to prevent spilling said waste prior to complete removal of said plastic shopping bag from said rectangular wastebasket.

3. A wastebasket according to claim 2, wherein said predetermined rectangular dimension and said predetermined height dimension are selected to accommodate dimensions of said plastic shopping bag.

4. A wastebasket according to claim 1, wherein said predetermined rectangular dimension and said predetermined height dimension are selected to accommodate dimensions of said plastic shopping bag.

* * * * *